US011649570B2

(12) United States Patent
Zhang et al.

(10) Patent No.: US 11,649,570 B2
(45) Date of Patent: May 16, 2023

(54) METALLIC CARD WIRE

(71) Applicant: GROZ-BECKERT KG, Albstadt (DE)

(72) Inventors: Yuning Zhang, Wuxi (CN); Piet Vanacker, Gentbrugge (BE)

(73) Assignee: GROZ-BECKERT KG, Albstadt (DE)

( * ) Notice: Subject to any disclaimer, the term of this patent is extended or adjusted under 35 U.S.C. 154(b) by 1076 days.

(21) Appl. No.: 15/311,614

(22) PCT Filed: May 5, 2015

(86) PCT No.: PCT/EP2015/059845
§ 371 (c)(1),
(2) Date: Nov. 16, 2016

(87) PCT Pub. No.: WO2015/173074
PCT Pub. Date: Nov. 19, 2015

(65) Prior Publication Data

US 2017/0096751 A1 Apr. 6, 2017

(30) Foreign Application Priority Data

May 16, 2014 (EP) ..... 14168630

(51) Int. Cl.
*D01G 15/88* (2006.01)

(52) U.S. Cl.
CPC ..... *D01G 15/88* (2013.01)

(58) Field of Classification Search
CPC ..... D01G 15/88; D01G 15/84–92
(Continued)

(56) References Cited

U.S. PATENT DOCUMENTS 2,937,412 A * 5/1960 Hollingsworth ..... D01G 15/84 19/114
4,612,084 A * 9/1986 Schmolke ..... C23F 1/00 216/91

(Continued)

FOREIGN PATENT DOCUMENTS

CN 102733012 A 10/2012
CN 102869821 A 1/2013

(Continued)

OTHER PUBLICATIONS

International Search Report in corresponding International Application No. PCT/EP2015/059845, dated Jul. 29, 2016, 3 pages.

(Continued)

*Primary Examiner* — Khoa D Huynh
*Assistant Examiner* — Aiying Zhao
(74) *Attorney, Agent, or Firm* — Fitch, Even, Tabin & Flannery LLP

(57) ABSTRACT

The metallic card wire (100) includes a rib portion (110) and a plurality of teeth (115). The teeth have a tip segment (117), a front portion (120), a back portion (130), two sides (141, 142) and an interconnection section connecting the back portion of a tooth to the front portion of the previous tooth. The teeth lean in the card wire longitudinal direction. The teeth's front portion leans towards the longitudinal direction. The front portion includes an undercut segment where the included angles of the tangents to the front portion with the longitudinal direction of the card wire are smaller than the included angles of the tangents to the front portion with the longitudinal direction of the card wire between the undercut segment and the tip segment. At least one side of the teeth includes at least a first structural element for increasing the frictional force of fibers relative to the side of the teeth and (Continued)

positioned closer to the tip segment compared to the undercut segment's position.

15 Claims, 6 Drawing Sheets

(58) Field of Classification Search
USPC ..... 19/114
See application file for complete search history.

(56) References Cited

U.S. PATENT DOCUMENTS

| | | | | |
|---|---|---|---|---|
| 5,755,012 | A | 5/1998 | Hollingsworth | |
| 8,745,826 | B2 | 6/2014 | Vangheluwe et al. | |
| 2004/0128800 | A1* | 7/2004 | Graf | D01G 15/88 19/114 |
| 2012/0255143 | A1* | 10/2012 | Iten | D01G 15/88 19/106 R |
| 2013/0042437 | A1 | 2/2013 | Vangheluwe et al. | |

FOREIGN PATENT DOCUMENTS

| | | | |
|---|---|---|---|
| FR | 2821863 | A1 | 9/2002 |
| JP | 32-005227 | B | 7/1957 |
| JP | 33-017316 | B | 10/1958 |
| JP | 36-004914 | Y | 3/1961 |
| JP | 48-040514 | U | 5/1973 |
| JP | S48-21127 | B | 6/1973 |
| JP | 51-028408 | Y | 7/1976 |
| JP | 54-184386 | U | 12/1979 |
| JP | S59-110387 | A | 6/1984 |
| JP | S6130082 | U | 2/1986 |
| JP | H01-306625 | A | 12/1989 |
| JP | 05-072974 | U | 10/1993 |
| JP | 2004-131920 | A | 4/2004 |
| JP | 2013-528714 | A | 7/2013 |
| KR | 10-2013-0064065 | A | 6/2013 |
| WO | 0026450 | A1 | 5/2000 |
| WO | 2011138322 | A1 | 11/2011 |
| WO | 2012019841 | A1 | 2/2012 |
| WO | 2013037711 | A1 | 3/2013 |

OTHER PUBLICATIONS

First Chinese Office Action and Search Report dated Jun. 26, 2018 for corresponding Chinese Application No. 201580025403.4, with English Translation (25 pgs.).

Chinese Second Office Action dated Mar. 11, 2019, in corresponding Chinese Patent Application No. 201580025403.4, with English Translation (10 pgs.).

Japanese Office Action dated May 22, 2019, in corresponding Japanese Patent Application No. 2016-559631, with English Translation (16 pgs.).

Indian Office Action dated Nov. 23, 2020, in corresponding Indian Application No. 201637026450 (8 pages).

Chinese Third Office Action dated Sep. 29, 2019, in corresponding Chinese Application No. 201580025403.4, with machine English translation (5 pages).

Japanese Second Office Action dated Jan. 28, 2020, in corresponding Japanese Application No. 2016-559631, with English translation (10 pages).

Korean Preliminary Rejection dated Apr. 30, 2021, in corresponding Korean Application No. 10-2016-7025986, with English translation (14 pages).

* cited by examiner

METALLIC CARD WIRE

CROSS REFERENCE TO RELATED APPLICATIONS

This patent application is the national phase of PCT/EP2015/059845 filed May 5, 2015, which claims the benefit of European Patent Application No. 14168630.3 filed May 16, 2014.

TECHNICAL FIELD

The invention relates to a metallic card wire, for being mounted on rollers of carding machines used in textile industry.

BACKGROUND

Cards (carding machines), whether revolving flat cards or roller cards, are equipped with rollers clothed with card wire; and are possibly provided with additional carding elements such as fixed flats or revolving flats also covered with card wire. Cards have the task to open tufts of fibers, by tearing the fiber tufts apart into smaller fiber tufts or even into individual fibers. This is achieved in a number of consecutive steps, with in each step the relative movement between two objects clothed with card wire: tufts held by one or more teeth of the card wire of the first object are opened because teeth of the card wire of the second object are pulling smaller tufts or individual fibers out of the tufts held on the first object. Such objects can be rollers or flats. Examples are the interaction between lickerin and carding segments mounted on a lickerin roller, the interaction between lickerin and cylinder, the interaction between cylinder and revolving flats, the interaction between cylinder and doffer and the interaction on a roller card between cylinder and worker rollers.

The objective of carding is—through the interaction of subsequent pairs of objects clothed with card wires—to have an effective and efficient reduction of tuft size or even individualization of the fibers; as well as an effective transfer of the fibers from a roller clothed with card wire to a next roller clothed wire card wire of the carding machine.

Especially for workers and doffer rollers of revolving flat cards and/or roller cards, several shapes of metallic card wire have been described. The use is known of card wires with longitudinal grooves or outward longitudinal ridges at one or both sides of the teeth of the card wire, e.g. from US2004/0128800A1.

WO00/026450A1 describes a card wire with enhanced fiber taking ability by forming one or more undercuts on the forward or inside face of the overhanging teeth of carding wire. The undercut preferably includes a portion substantially parallel to the longitudinal direction of the wire.

WO2011/138322A1 describes a card wire comprising a rib portion and a plurality of teeth over the length of the rib portion. The teeth are sloped with a back slope representing the backbone of the teeth and a front slope representing the side in direct contact with fiber. The back slope has a tangent forming a back angle with the rib portion. The front slope is divided into at least two segments, a tip segment converging with the back slope to form a tip of the teeth. The tip segment serves to penetrate between fibers. The tip segment has a tangent forming a tip angle with the rib portion, and an undercut segment for retaining the fibers. The undercut has a tangent forming an undercut angle with the rib portion; the undercut angle is at each point in the undercut segment greater than the maximum of the back angle and being smaller than the smallest value of the tip angle. It is the benefit of such a card wire that it can be made by means of rotary punching. WO2011/138322A1 mentions that the wire can be provided with striations—grooves/veins along the longitudinal direction of the wire profile—at the undercut segment or below the undercut segment in order to increase fiber retention capabilities.

WO2012/019841A1 describes a card wire comprising an elongated rib portion and teeth. The teeth have a front portion and a back portion. The teeth hang over towards their front portion. The front portion and back portion merge at the tip of the tooth. The front portion comprises at least three sections: a first section extends from the tip of the tooth in the direction of the rib portion, a second section extends below the first section in the direction of the rib portion and a third section extends from the end of the second section in the direction of the rib portion. The second section comprises a straight part and a curved segment, wherein the straight part has a minimum length of 0.10 mm and the straight part has an angle between 10 and 30 degrees relative to the length direction of the card wire. The straight part is followed by the curved segment wherein the curved segment has a radius of at least 0.18 mm. Compared to the wire of WO00/026450A1, WO2012/019841A1 provides a card wire with higher strength and fatigue resistance against the load by the fibers on the teeth of the card wire due to the carding action. WO2012/019841A1 allows providing card wires with more points per square inch once mounted on a roller on a card. WO2012/019841A1 indicates that the wire can be provided with striations—grooves/veins along the longitudinal direction of the wire profile—at the undercut segment or below the undercut segment in order to increase fiber retention capabilities.

The wires of WO00/026450A1, WO2011/138322A1 and WO2012/019841A1 have the common feature of an undercut segment in the front portion of the teeth.

U.S. Pat. No. 4,612,084A presents a method of reducing the adherence of fibers to the teeth of metallic card wire by treating edges of the teeth in a manner that sharp edges of the teeth are rounded. The improvement comprises treating the teeth of the metallic card wire by subjecting the metallic card wire to a chemical deburring bath wherein sharp edges of the teeth are rounded by chemical deburring.

SUMMARY

The primary objective of the invention is to provide a card wire with an undercut segment that has good fiber taking ability but that is less prone to fiber loading and which has a long functional lifetime. Fiber loading can be defined as fibers accumulating in the card wire on the card; and which are not or only with difficulty removed by the card wire of a next roller on the card. Loading leads to quality and productivity problems during carding. Loading can only be removed by stopping the card and cleaning the card wire.

A first aspect of the invention is a metallic card wire comprising a rib portion and a plurality of teeth. The teeth have a tip segment, a front portion, a back portion, two sides and an interconnection section. The interconnection section connects the back portion of a tooth to the front portion of the previous tooth. The tip segment is where the front portion and the back portion merge. The teeth are leaning in the longitudinal direction of the card wire. The front portion is where the teeth are leaning towards the longitudinal direction of the teeth. The front portion comprises an undercut segment. The undercut segment is a segment of the front portion of the card wire where the included angles of the tangents to the front portion with the longitudinal direction of the card wire are smaller than the included angles of the tangents to the front portion of the card wire with the longitudinal direction of the card wire in the zone between the undercut segment and the tip segment. The undercut segment is capable of taking fibers from a previous roller clothed with card wire, thereby increasing the effect of carding. At least one side of the teeth, and possibly both sides of the teeth, comprises at least a first structural element for increasing the frictional force of fibers relative to the side of the teeth, wherein the at least a first structural element is positioned closer to the tip segment compared to the position of the undercut segment. Preferably, in the undercut segment, each of the included angles are at least 3°, and more preferably at least 5°, and even more preferably at least 10°, even more preferably 15°, smaller than the smallest included angle in the zone between the undercut segment and the tip segment.

Implicitly, an undercut segment of teeth of metallic card wires is made at a certain distance from the tip of the card wire. As the fibers are held by the undercut segment at that distance from the tip segment, the risk exists that fibers taken by the undercut segment cannot be taken by card wires that have to remove the fibers from the undercut segment; resulting in the risk of loading.

From prior art, structural elements at the side or sides of the teeth are known to enhance fiber taking ability, and therefore increase the risk of loading of the card wire. When the skilled person is faced with the problem to reduce loading of a card wire having an undercut segment in the front, he will not be tempted to consider an additional fiber taking structural element in the card wire. He would rather modify the undercut segment that is responsible for fiber taking and fiber loading.

Surprisingly however, the presence at at least one side of the teeth of the metallic card wire of at least a first structural element for increasing the frictional force of fibers relative to the side of the teeth, wherein the structural element is positioned closer to the tip segment of the card wire compared to the position of the undercut segment, resulted in a reduction of the risk of loading of the metallic card wire. The surprising beneficial effect of the card wire of the invention is believed to be caused by a number of synergistic effects. A structural element positioned closer to the tip segment than the undercut segment will itself take fibers. Therefore, the structural element will reduce the fiber taking capability of the undercut segment. The structural element will have an interaction with the card wire on the previous roller wire on which the fibers are present, and from which the fibers are to be taken. The structural element has a fiber taking ability less than the undercut segment; it will itself take a number of fibers (although some will be taken back immediately by the card wire on which the fibers were present). The fibers will however on average be positioned higher on the inventive card wire because of the presence and position of the structural element, facilitating the fibers being taken by a next roller on the card. Thus, although the wire of the invention has good fiber taking capabilities, it reduces the risk of loading of the card wires.

In a preferred embodiment of the invention, the at least a first structural element comprises an indentation in the side of the teeth. Preferably, the at least a first structural element consists out of one or more indentations in the side of the teeth. Preferably, the at least a first structural element does not comprise parts bulging out of the plane of the side of the teeth. A structural element shaped comprising or consisting out of one or more indentations creates a synergistic benefit. An indentation does not reduce the width of free space between two rows of teeth of the card wire wound on a roller. Structural elements comprising or consisting out of a structural element bulging from the side of the teeth, cause a reduction of the free space available between rows of card wire on the roller on the card, reducing the loading-reducing effect of the structural element. A skilled person would not be tempted to add a structural element comprising (or consisting out of) one or more indentations in the side of the teeth between the undercut segment and the tip segment. The blade of the teeth is thin in this position (as the blade of the teeth is made smaller towards the tip of the teeth) and an indentation will cause a reduction of the strength of the card wire. Strength of the card wire is important, as in acknowledged in WO2013/037711A1, solving a problem of WO00/026450A1. Weak teeth lead to broken teeth, reducing the functionality of the card wire, and thus reducing its functional lifetime.

Surprisingly, it has been noticed that card wires according to this embodiment have long lifetime. It is believed that this benefit results from the loading-reducing benefits which also reduce the forces on the teeth of the card wires as fiber retention forces are lower.

Preferably, the indentation is a groove, preferably with substantially constant cross section, along the longitudinal direction of the metallic card wire.

Preferably, the largest depth of the indentation is more than 0.03 mm, preferably more than 0.05 mm.

Preferably, the smallest radius of curvature in the groove is at least 0.05 mm, more preferably at least 0.10 mm, more preferably at least 0.15 mm. Such feature provides synergistic benefits to the functional lifetime of the card wire with reduced loading, thanks to the higher strength of the teeth because of lower stresses in the tooth. In a preferred embodiment the groove has at its deepest part a section that is substantially flat.

In a preferred embodiment, the at least a first structural element comprises one or more protrusions from the side of the teeth. Preferably, the protrusion is a ridge, preferably with constant cross section along the longitudinal direction of the metallic card wire. Preferably, the largest height of the protrusion is more than 0.03 mm, preferably more than 0.05 mm. With height of the protrusion is meant the distance over which the protrusion extends out of the plane of the side of the teeth.

In a preferred embodiment, the back portion of the tooth has a tangent forming a back angle with the longitudinal direction of the card wire. The zone of the front portion above the undercut segment has a tangent forming a tip angle with the rib portion. The undercut segment is capable of retaining fibers. The undercut segment has a tangent forming an included angle, the undercut angle, with the longitudinal direction of the card wire. The undercut angle is at each point in the undercut segment greater than the maximum of the back angle and smaller than the smallest value of the tip angle in order to allow rotary punching to produce the card wire.

In a preferred embodiment, the front portion comprises at least three sections;

a first section extends from the tip segment of the tooth in the direction of the rib portion;

a second section extends below the first section in the direction of the rib portion, wherein the second section comprises the undercut segment;

wherein the second section comprises a straight part and a curved segment, the straight part has a minimum length of 0.10 mm and the straight part has an angle between 10 and 30 degrees relative to the longitudinal direction of the card wire, and the straight part is followed in the direction of the rib portion by the curved segment wherein the curved segment has a radius of at least 0.18 mm; and the front portion comprises a third section from the end of the second section to the interconnection section.

In a preferred embodiment, the undercut segment is the bottom part of an embossment on the front portion of the metallic card wire; preferably wherein the metallic card wire has an embossment at the back portion of the metallic card wire.

In any of the embodiments described, the back portion can comprise an embossment, preferably wherein the embossment is located more distant from the tip segment of the tooth than the structural element.

In any of the embodiments described, one or both sides of the teeth can comprise one or more additional structural elements, located at the height of the undercut segment and/or below the undercut segment. Preferably, the one or more additional structural elements are selected from or are combinations of grooves and/or ridges in longitudinal direction of the card wire.

In an embodiment of the invention, the sides of the teeth have over their surface a mat appearance as caused by a blasting operation with abrasive particles. Such feature can be combined with any of the embodiments mentioned. The feature of this embodiment provides a synergistic effect with the structural element positioned closer to the tip segment of the card wire compared to the position of the undercut segment and improves its functionality. Such a mat appearance can e.g. be obtained by means of a blasting operation of the card wire with abrasive particles, e.g. sand.

In an embodiment of the invention, the sides of the teeth have over their surface a roughness value Ra between 0.2 and 0.33 μm. The roughness value Ra is determined in surface roughness measurements in accordance with accepted standard test methods, wherein the measurement is performed at a traversing speed of 0.5 mm/s. Ra is the arithmetic mean of the departures of the profile from the mean line. The feature can be combined with any of the embodiments mentioned in this document. The feature of this embodiment provides a synergistic effect with the structural element positioned closer to the tip segment of the card wire compared to the position of the undercut segment and improves its functionality. It is e.g. possible to obtain such a roughness value by means of a blasting operation of the card wire with abrasive particles, e.g. sand.

In an embodiment of the invention, the thickness of the teeth at the tip is less than 0.25 mm, preferably less than 0.20 mm.

Preferably in each of the embodiments, all teeth along the length of the metallic card wire are substantially similar.

DETAILED DESCRIPTION

In the figures, same numerals indicate same objects.

Figure 1:
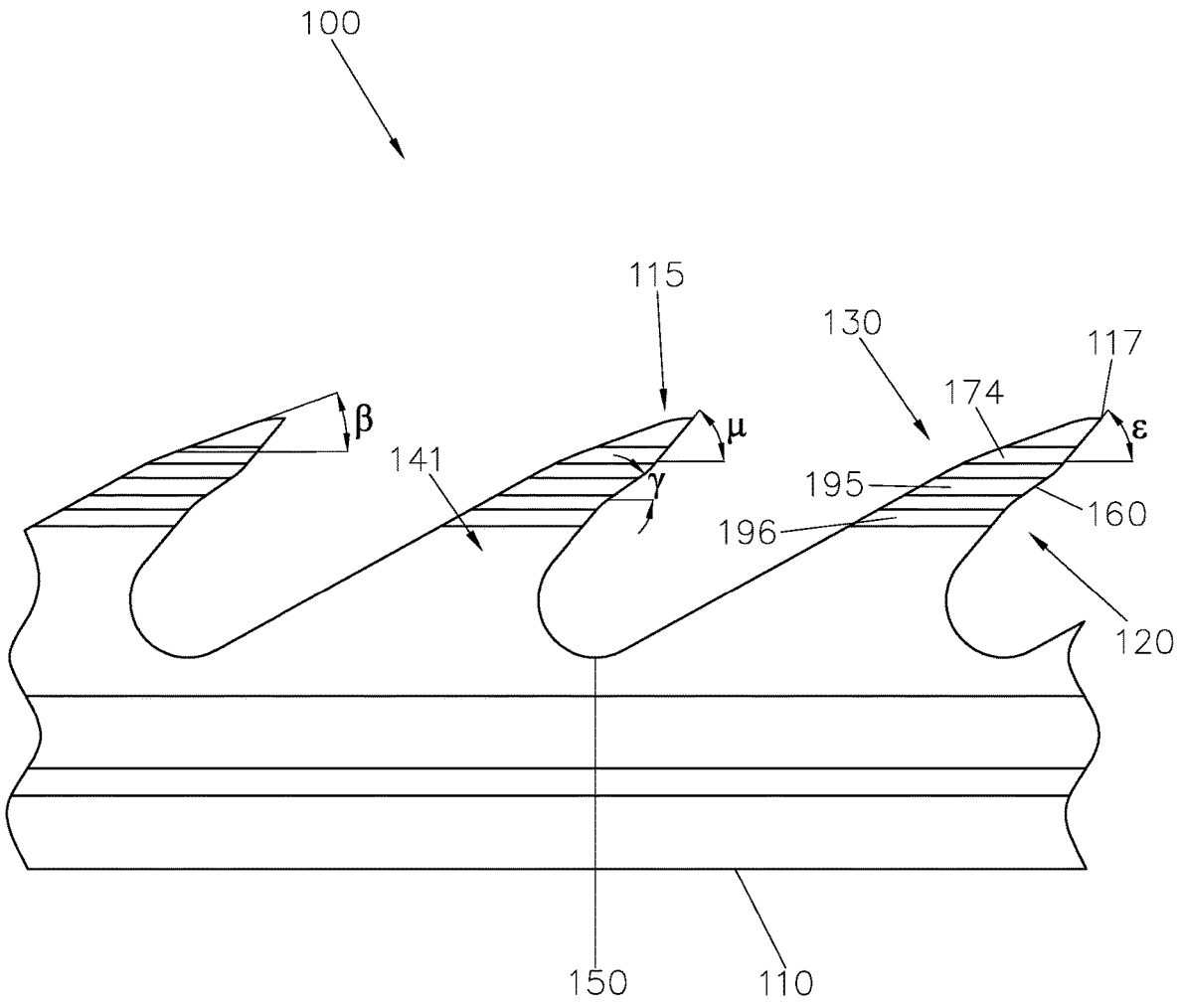
FIG. 1 shows a longitudinal view of a metallic card wire according to the invention.

FIG. 1 shows a longitudinal view of a metallic card wire 100 according to the invention.

Figure 2:
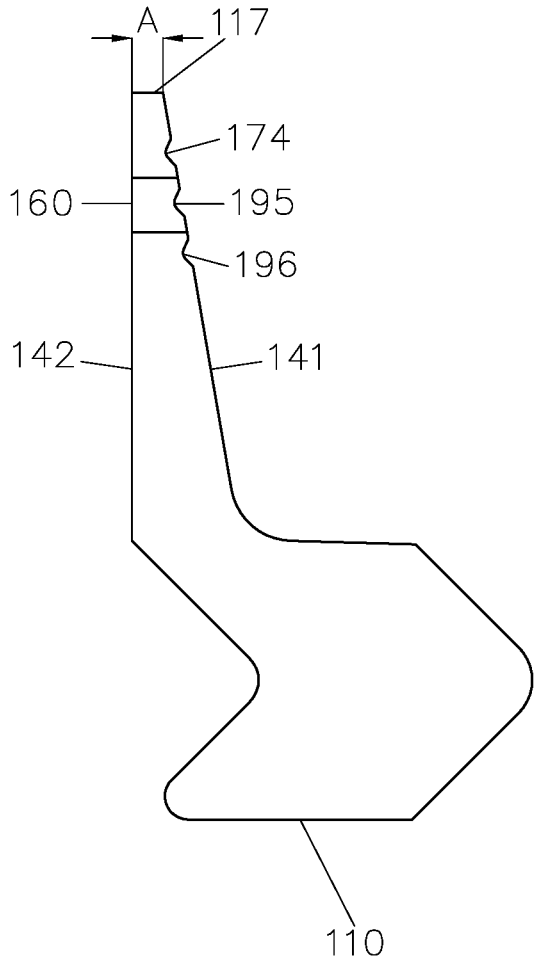
FIG. 2 shows the cross section of the card wire of FIG. 1.

FIG. 2 shows the cross section of the card wire of FIG. 1. The metallic card wire comprises a rib portion 110 and a plurality of teeth 115. The teeth 115 have a tip segment 117, a front portion 120, a back portion 130, two sides 141, 142 and an interconnection section 150, connecting the back portion 130 of a tooth to the front portion 120 of the previous tooth. The front portion 120 comprises an undercut segment 160. The undercut segment 160 is a segment of the front portion 120 of the card wire 110 where the included angles y of the tangents to the front portion with the longitudinal direction of the card wire are smaller than the included angles ε of the tangents to the front portion of the card wire with the longitudinal direction of the card wire in the zone between the undercut segment and the tip segment 117. One side 141 of the teeth comprises a longitudinal groove 174 parallel with the rib portion 110. The groove 174 is positioned closer to the tip segment 117 compared to the position of the undercut segment 160. The depth of the groove 174 at its deepest point is e.g. 0.06 mm from the plane of the side 140 of the teeth. In a preferred embodiment the groove has at its deepest part a section that is substantially flat. The teeth 115 have two additional longitudinal grooves 195, 196; wherein one additional longitudinal groove 195 is located at the height of the undercut segment 160 and one additional longitudinal groove 196 is located below the undercut segment 160.

The back portion 130 of the exemplary card wire 100 of FIG. 1 has a tangent forming a back angle β with the longitudinal direction of the card wire 100. The zone above the undercut segment 160 has a tangent forming a tip angle μ with the longitudinal direction of the card wire 100. The undercut segment is capable of retaining fibers. The undercut segment has a tangent forming an included angle γ, the undercut angle γ, with the longitudinal direction of the card wire. The undercut angle γ is at each point in the undercut segment 160 greater than the maximum of the back angle β and smaller than the smallest value of the tip angle μ in order to allow rotary punching. The thickness of the tooth at the tip A is e.g. 0.25 mm or e.g. 0.20 mm. As an example, the maximum of back angle β is 20°; the undercut angle γ is 35° and the smallest value of the tip angle μ equals 50°.

Figure 3:
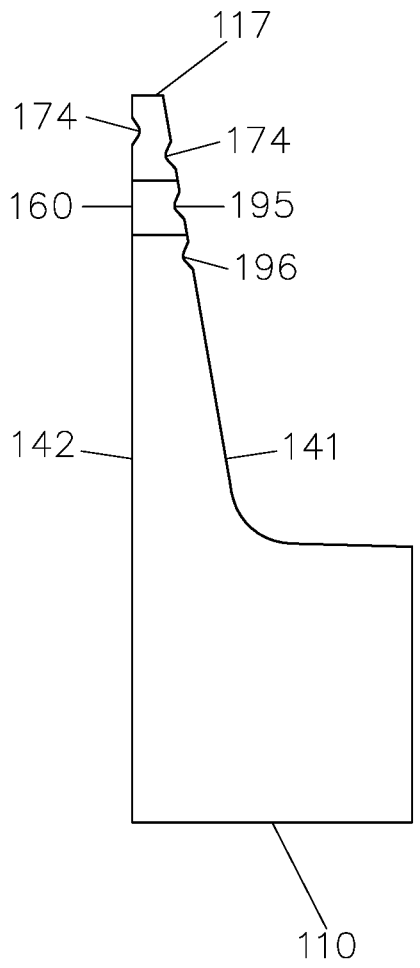
FIGS. 3 and 4 show examples of alternative cross sections of metallic card wires according to the invention

FIG. 3 shows an example of an alternative cross section of a metallic card wire according to the invention. Both sides 141, 142 are provided with a longitudinal groove 174 between the undercut segment 160 and the tip segment 117. Additionally and optionally, the teeth can e.g. be provided with a longitudinal groove 195 at the height of the undercut segment 160 and/or below the undercut segment 160.

Figure 4:
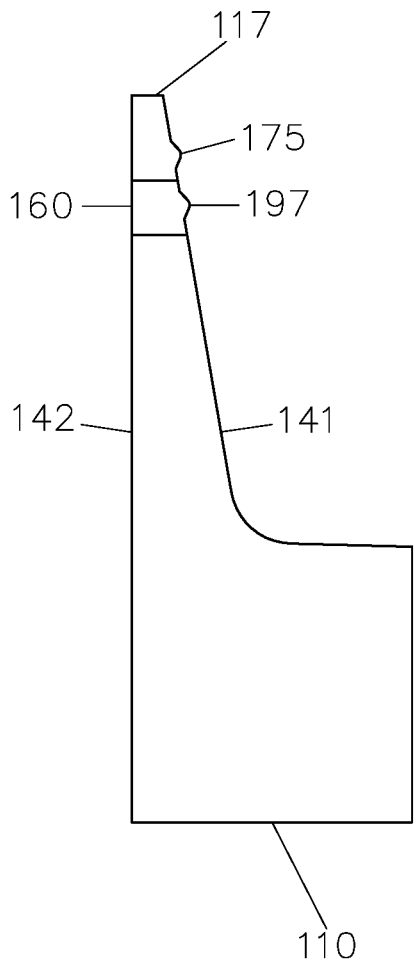

One or more grooves on the teeth can be replaced by longitudinal ridges, e.g. as shown in the cross section of an inventive metallic card wire in FIG. 4. One side 141 is provided with a longitudinal ridge 175 between the undercut segment 160 and the tip segment 117. Additionally and optionally, the teeth can e.g. be provided with a longitudinal ridge 197 at the height of the undercut segment 160. It is also possible to provide one or more ridges below the undercut segment 160, and/or to provide ridges at both sides; and/or to provide combinations of ridges and grooves.

Figure 5:
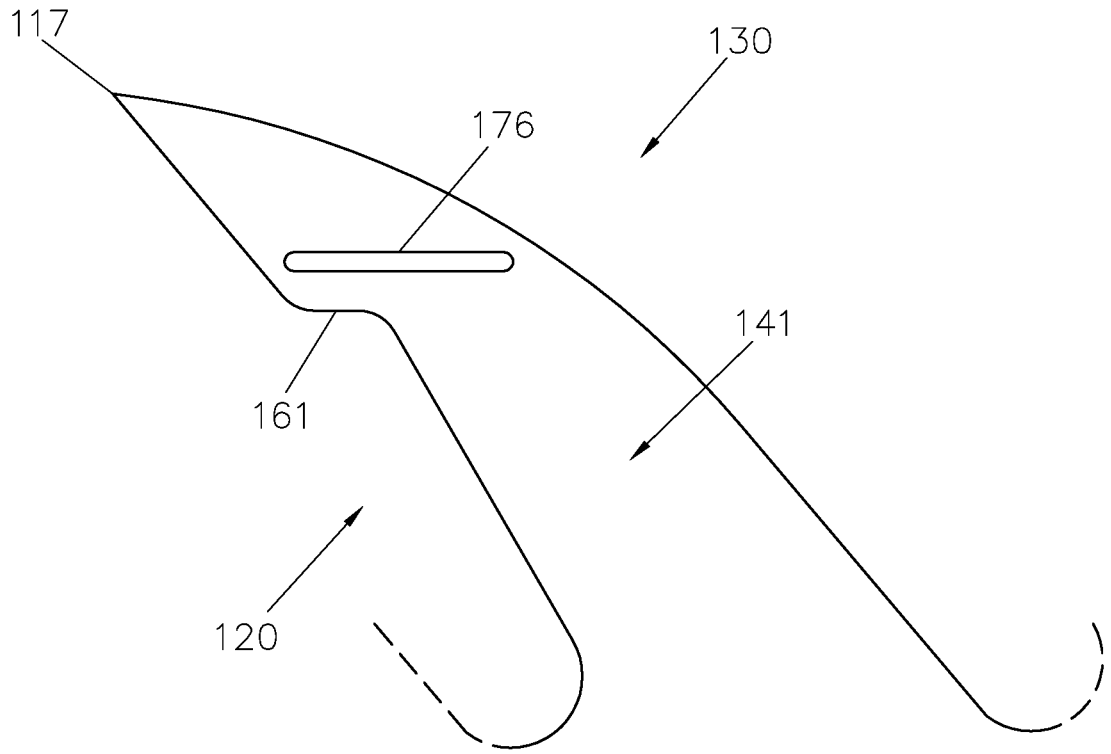
FIGS. 5 and 6 show other examples of teeth of card wires according to the invention.

FIG. 5 shows an example of a tooth of a card wire according to the invention. The tooth shows on one of its sides 141, above the undercut segment 161 (which is in this wire parallel with the longitudinal direction of the card wire, but could be any other type of undercut segment) an indentation 176.

Figure 6:
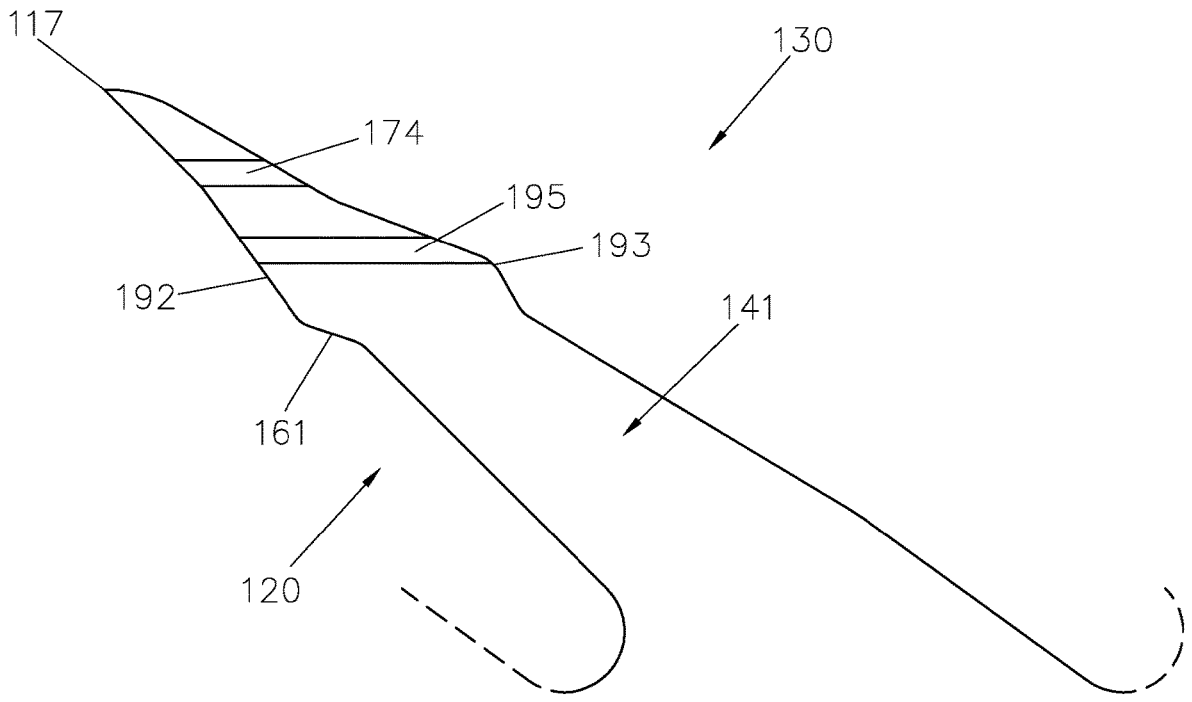

FIG. 6 shows an example of a tooth of a card wire according to the invention. The tooth shows on one of its sides 141, above the undercut segment 161 (which is in this wire the bottom part of an embossment 192 on the front portion 120 of the metallic card wire, but could be any other type of undercut segment) a longitudinal groove 174. Optionally, the tooth can have an embossment 193 in the back portion 130 of the card wire. Optionally, the tooth can have a longitudinal groove 195 at the height of the embossment 192.

Each of the examples of card wires shown can be treated to provide the sides of the teeth (and possibly the sides of the card wire) over their surface with a mat appearance as caused by a blasting operation with abrasive particles; and/or to provide the sides of the teeth (and possibly also the sides of the card wire) to have over their surface a roughness value Ra between 0.2 and 0.33 μm. Such surface can be achieved by means of a blasting operation with abrasive particles as is known in the art.

The invention claimed is:

1. Metallic card wire comprising:

a rib portion and a plurality of teeth;

wherein individual ones of the plurality of teeth have a tip segment, a front portion, a back portion, two sides and an interconnection section;

wherein the interconnection section connects the back portion of a tooth of the plurality of teeth to the front portion of a previous tooth of the plurality of teeth;

wherein the tip segment is where the front portion and the back portion merge;

wherein the teeth are leaning in a longitudinal direction of the card wire;

wherein the front portion is where the teeth are leaning towards the longitudinal direction of the teeth, wherein at least one side of the teeth comprises at least a first structural element comprising an indentation and/or protrusion configured to increase a frictional force of fibers relative to the at least one side of the teeth, wherein the at least a first structural element comprising an indentation and/or protrusion is positioned closer to the tip segment compared to any undercut segment;

wherein the front portion comprises the undercut segment;

wherein the undercut segment is a segment of the front portion of the card wire, wherein in the undercut segment included angles of tangents to the front portion with the longitudinal direction of the card wire are smaller than included angles of tangents to the front portion of the card wire with the longitudinal direction of the card wire in a zone between the undercut segment and the tip segment.

2. A metallic card wire as in claim 1, wherein the at least a first structural element comprises an indentation in the at least one side of the teeth.

3. A metallic card wire as in claim 2, wherein the indentation is a groove.

4. A metallic card wire as in claim 2, wherein a largest depth of the indentation is more than 0.03 mm.

5. A card wire as in claim 1, wherein the at least a first structural element comprises one or more protrusions from the at least one side of the teeth.

6. A card wire as in claim 5, wherein the protrusion is a ridge.

7. A card wire as in claim 5, wherein a largest height of the protrusion is more than 0.03 mm.

8. A metallic card wire as in claim 1;

wherein the back portion has a tangent forming a back angle with the longitudinal direction of the card wire;

wherein the zone of the front portion above the undercut segment has a tangent forming a tip angle with the rib portion;

wherein the undercut segment is configured to retain fibers;

wherein the undercut segment has a tangent forming an included undercut angle with the longitudinal direction of the card wire;

wherein the undercut angle is at each point in the undercut segment greater than a maximum of the back angle and smaller than a smallest value of the tip angle to allow rotary punching.

9. A metallic card wire as in claim 1, wherein the front portion comprises at least three sections including a first section extending from the tip segment of the tooth in the direction of the rib portion and a second section extending below the first section toward the rib portion, wherein the second section comprises the undercut segment;

wherein the second section comprises a straight part and a curved segment, the straight part has a minimum length of 0.10 mm and the straight part has an angle between 10 and 30 degrees relative to the longitudinal direction of the card wire, and the straight part is followed in the direction of the rib portion by the curved segment wherein the curved segment has a radius of at least 0.18 mm; and the front portion comprises a third section from an end of the second section to an interconnection section.

10. A metallic card wire as in claim 1, wherein the undercut segment is a bottom part of an embossment on the front portion of the metallic card wire.

11. A metallic card wire as in claim 1, wherein the back portion comprises an embossment.

12. A metallic card wire as in claim 1, wherein one or both sides of the teeth comprise one or more additional structural elements, located at a height of the undercut segment and/or below the undercut segment.

13. A metallic card wire as in claim 1, wherein both sides of the teeth have over their surface a mat appearance as caused by a blasting operation with abrasive particles.

14. A metallic card wire as in claim 1, wherein both sides of the teeth have over their surface a roughness value Ra between 0.2 and 0.33 μm.

15. A metallic card wire as in claim 1, wherein a thickness of the teeth at a tip is less than 0.25 mm.

* * * * *